US005876905A

United States Patent [19]

Irving et al.

[11] Patent Number: 5,876,905

[45] Date of Patent: Mar. 2, 1999

[54] DUAL-COATED RADIOGRAPHIC ELEMENT CAPABLE OF PHOTOTHERMOGRAPHIC IMAGING

[75] Inventors: Mark E. Irving; David H. Levy, both of Rochester; Lyn M. Eshelman, Penfield; Debra L. Hartsell, Webster, all of N.Y.

[73] Assignee: Eastman Kodak Company, Rochester, N.Y.

[21] Appl. No.: 822,095

[22] Filed: Mar. 20, 1997

[51] Int. Cl.[6] ..... G03C 1/498; G03C 5/16

[52] U.S. Cl. ..... 430/350; 430/543; 430/559; 430/567; 430/619; 430/966; 430/967

[58] Field of Search ..... 430/350, 619, 430/559, 567, 226, 966, 543, 967, 217, 617, 203, 222

[56] References Cited

U.S. PATENT DOCUMENTS

| | | | |
|---|---|---|---|
| 4,414,310 | 11/1983 | Daubendiek et al. . | |
| 4,425,425 | 1/1984 | Abbott et al. . | |
| 4,425,426 | 1/1984 | Abbott et al. . | |
| 4,435,499 | 3/1984 | Reeves . | |
| 4,480,024 | 10/1984 | Lyons et al. | 430/139 |
| 4,504,568 | 3/1985 | Clark et al. . | |
| 4,803,150 | 2/1989 | Dickerson et al. . | |
| 4,900,652 | 2/1990 | Dickerson et al. . | |
| 5,252,442 | 10/1993 | Dickerson et al. . | |
| 5,264,337 | 11/1993 | Maskasky . | |
| 5,275,930 | 1/1994 | Maskasky . | |
| 5,292,632 | 3/1994 | Maskasky . | |
| 5,314,798 | 5/1994 | Brust et al. . | |
| 5,320,938 | 6/1994 | House et al. . | |
| 5,356,764 | 10/1994 | Szajewski et al. . | |
| 5,395,746 | 3/1995 | Brust et al. . | |
| 5,468,587 | 11/1995 | Bailey et al. . | |

FOREIGN PATENT DOCUMENTS

| | | |
|---|---|---|
| 0 654 703 A1 | 5/1995 | European Pat. Off. . |

OTHER PUBLICATIONS

Research Disclosure, vol. 184, Aug. 1979, Item 18431.
Research Disclosure, vol. 170, Jun. 1978, Item 17029.
Research Disclosure, vol. 299, Mar. 1989, Item 29963.

*Primary Examiner*—Thorl Chea
*Attorney, Agent, or Firm*—Carl O. Thomas

[57] ABSTRACT

A dual-coated radiographic element capable of producing a viewable image when heated following imagewise exposure is disclosed comprised of, on opposite sides of a transparent film, layer units containing radiation-sensitive radiation-sensitive silver halide grains, a light-insensitive source of silver, and a reducing agent for said light-insensitive reducible source of silver. Greater than 50 percent of total projected area of said silver halide grains being provided by tabular grains (a) having {100} major faces, (b) containing greater than 70 mole percent chloride, based on silver, (c) exhibiting an average thickness of less than 0.3 $\mu$m, and (d) exhibiting an average equivalent circular diameter of greater than 0.6 $\mu$m.

20 Claims, No Drawings

DUAL-COATED RADIOGRAPHIC ELEMENT CAPABLE OF PHOTOTHERMOGRAPHIC IMAGING

FIELD OF THE INVENTION

The invention relates to radiographic elements. More specifically, the invention relates to radiographic elements capable of photothermographic imaging.

DEFINITION OF TERMS

All references to silver halide grains and emulsions containing two or more halides name the halides in order of ascending concentrations.

The terms "high chloride" and "high bromide" in referring to silver halide grains and emulsions indicates chloride and bromide concentrations, respectively, of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The terms "{111} tabular" and "{100} tabular" in referring to grains and emulsions indicate that the tabular grain grains have major faces lying in {111} or {100} crystal lattice planes, respectively.

The term "tabular grain emulsion" refers to an emulsion in which tabular grains account for greater than 50 percent of total grain projected area.

The term "dual-coated" is employed to indicate radiographic elements having image forming layer units coated on opposite sides of a support.

The term "fluorescent intensifying screen" refers to a screen that absorbs X-radiation and emits light.

The term "crossover" as herein employed refers to the percentage of light emitted by a fluorescent intensifying screen that strikes a dual-coated radiographic film and passes through its support to reach the image forming layer unit coated on the opposite side of the support.

The terms "front" and "back" refer to features or elements nearer to and farther from, respectively, the X-radiation source than the support of the radiographic element.

The term "rare earth" is used to indicate elements having an atomic number of 39 or 57 through 71.

The term "photothermographic imaging" is applied to photographic imaging that relies on light exposure to produce a latent image and the application of heat alone to convert the latent image to a viewable image.

The terms "kVp" and "MVp" stand for peak voltage applied to an X-ray tube X $10^3$ and $10^6$, respectively. These terms are sometimes also written as "kVcp" and "MVcp" to emphasize that the value named is the continuously applied peak voltage as opposed to a transient peak.

The term "image discrimination" is defined as the difference between maximum and minimum densities—i.e., $D_{max}-D_{min}$.

*Research Disclosure* is published by Kenneth Mason Publications, Ltd., Dudley House, 12 North St., Emsworth, Hampshire P010 7DQ, England.

BACKGROUND

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5 percent or less of the exposing X-radiation passing through the patient is absorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element. Crossover of light from one fluorescent screen to an emulsion layer on the opposite side of the support of the radiographic element results in a significant loss of image sharpness. For medical diagnostic imaging, film contrast typically ranges from about 1.8 to 3.2, depending upon the diagnostic application. Crossover is minimized. In the highest speed diagnostic dual-coated radiographic elements, those employing spectrally sensitized tabular grain emulsions, crossover typically can range up to about 25% in the absence of other crossover control measures. In fact, it is common practice to add processing solution decolorizable dye particles to reduce crossover to near zero. X-radiation exposure energies vary from about 25 kVp for mammography to about 140 kVp for chest X-rays.

Following imagewise exposure diagnostic radiographic elements receive aqueous processing in a rapid-access processor to produce a dry, viewable silver image in 90 seconds or less. For example, the Kodak X-OMAT M6A-N™ rapid access processor employs the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer exhibits the following composition:

| | |
|---|---|
| Hydroquinone | 30 g |
| Phenidone ™ | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |
| Glutaraldehyde | 4.9 g |
| Water to 1 liter/pH 10.0 | |

A typical fixer exhibits the following composition:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9–4.5 | |

Dual coated radiographic elements intended for rapid access aqueous processing typically employ high bromide {111} tabular grain emulsions that contain less than 3 mole percent iodide, based on silver. Limiting iodide to less than 3 mole percent facilitates rapid access aqueous processing.

Examples of radiographic element construction for medical diagnostic purposes as well as exposure and processing are provided by Abbott et al U.S. Pat. Nos. 4,425,425 and 4,425,426, Dickerson U.S. Pat. No. 4,414,310, Kelly et al U.S. Pat. Nos. 4,803,150 and 4,900,652, Tsaur et al U.S. Pat. No. 5,252,442, and *Research Disclosure*, Vol. 184, August 1979, Item 18431.

Photothermographic imaging systems have been employed for producing silver images. Typically these imaging systems have exhibited very low levels of radiation-sensitivity and have been utilized primarily where only low imaging speeds are required. The most common use of photothermographic elements is for copying documents. Summaries of photothermographic imaging systems are published in *Research Disclosure*, Vol. 170, June 1978, Item 17029, and Vol. 299, March 1989, Item 29963.

Reeves U.S. Pat. No. 4,435,499, which was the first to teach the use of tabular grain emulsions in photothermographic elements, identified a clear preference for tabular grain emulsions in which tabular grains account for at least 70 percent of total grain projected area, have an average ECD in the range of from 0.30 to 0.45 $\mu$m, and have an average aspect ratio of from 5 to 15. Notice that the maximum preferred average ECD of the tabular grains of Reeves is well below the typical minimum ECD of 0.6 $\mu$m of tabular grain emulsions typically present in radiographic elements. The lower ECD's of Reeves also resulted in a maximum preferred aspect ratio of 15, which is below the typical average aspect ratio of tabular grain emulsions contained in radiographic elements. Thus, the preferred emulsion selections of conventional radiography and Reeves for photothermography, respectively, are at least divergent, if not mutually exclusive.

The following patents relating to photothermography illustrate that tabular grain emulsions have from time-to-time been included among possible alternative silver halide emulsions:

Frank et al EPO 0 654 703 A1(note page 7, line 39);

Clark et al U.S. Pat. No. 4,504,568 (note column 4, line 51); and

Bailey et al U.S. Pat. No. 5,468,587 (note column 15, lines 46–58).

The fact that none of the Examples in Frank et al, Clark et al and Bailey et al employ a tabular grain emulsion provides clear evidence of the established preference for non-tabular grain emulsions in photothermographic systems.

Frank et al, Clark et al and Bailey et al are all directed to dye image transfer systems, which in itself may account for their willingness to consider tabular grain emulsions as a possible alternative. Whereas main-stream photography fixes out undeveloped silver halide grains to impart image stability (thereby increasing image discrimination, $D_{max}$–$D_{min}$) and to reduce light scatter on viewing. there is no convenient mechanism for removing undeveloped silver halide grains from photothermographic elements. Accordingly, there is a clear trend in photothermography toward image transfer systems, since they allow undeveloped silver halide grains to be hidden from view. Image transfer in itself degrades image sharpness, thereby limiting imaging uses to those that do not require significant magnification. Image transfer also increases the number of layers that must be constructed. Thus, Frank et al, Clark et al and Bailey et al escape some of the major disadvantages of retained image photothermographic systems only by incurring the known limitations of image transfer systems.

High chloride {100} tabular grain emulsions and their use in mainstream photographic systems are illustrated by Maskasky U.S. Pat. Nos. 5,264,337, 5,292,632 and 5,275,930, House et al U.S. Pat. No. 5,320,938, Brust et al U.S. Pat. No. 5,314,798, Szajewski et al U.S. Pat. No. 5,356,764, and Budz et al U.S. Pat. No. 5,395,746.

RELATED APPLICATIONS

Levy et al U.S. Ser. No. 08/740,110, filed Oct. 28, 1996, commonly assigned, titled A PHOTOTHERMOGRAPHIC ELEMENT FOR PROVIDING A VIEWABLE IMAGE, discloses an imaging element containing a photothermographic layer capable of providing a retained viewable image when imagewise exposed and heated. The layer contains high chloride {100} tabular grains.

Baker et al U.S. Ser. No. 08/820,865, filed concurrently herewith and commonly assigned, titled PORTAL RADIOGRAPHIC ELEMENT AND PROCESS FOR ITS USE, discloses a portal radiographic element in which photothermographic layer units are dual-coated on the opposite faces of a transparent film support. The layer units are capable of providing a retained viewable image when exposed and heated. Crossover is at least 30 percent.

The dual-coated photothermographic portal radiographic element is useful in a process of confirming the targeting of a beam of X-radiation of from 4 to 25 MVp directed at a selected anatomical feature of a subject in which (1) a radiation shield containing a port is placed between the subject and a source of X-radiation, (2) the element is located between a pair of fluorescent intensifying screens to receive X-radiation that has passed through the port and the subject, (3) X-radiation is directed toward the shield so that a portion passes through the port in the shield, and (4) thereafter the radiographic element is heated to produce a viewable image of the anatomy of the subject interposed between the port and the radiographic element.

A fundamental difference between portal radiographic imaging and medical diagnostic imaging is that in the former a massive dose of X-radiation (extending from 30 to 300 seconds) is employed to intentionally alter some anatomical feature of the subject being exposed, whereas in medical diagnostic imaging much lower energy levels of X-radiation are applied for shorter times to produce a diagnostic image while minimizing or avoiding altering any anatomical feature of the subject.

SUMMARY OF THE INVENTION

In one aspect, this invention is directed to a dual-coated radiographic element capable of producing a viewable image when heated following imagewise exposure comprised of a transparent film support having first and second major surfaces and, coated on each of said major surfaces, a layer unit for producing a viewable silver image following imagewise exposure and processing, wherein each layer unit is comprised of a vehicle, radiation-sensitive silver halide grains, a light-insensitive source of silver, and a reducing agent for said light-insensitive source of silver, greater than 50 percent of total projected area of said silver halide grains being provided by tabular grains (a) having {100} major faces, (b) containing greater than 70 mole percent chloride, based on silver, (c) exhibiting an average thickness of less than 0.3 $\mu$m, and (d) exhibiting an average equivalent circular diameter of greater than 0.6 $\mu$m.

It has been discovered quite surprisingly that medical diagnostic dual-coated radiographic elements capable of photothermographic imaging exhibit lower minimum densities and higher levels of image discrimination when high chloride {100} tabular grains are incorporated in place of high bromide {111} tabular grains, typically employed in radiographic elements that are intended for rapid access aqueous processing. It was entirely unexpected that high chloride {100} tabular grain emulsions are capable of offering the identified performance advantages.

It has been further observed that by selecting a color developing agent to serve as the reducing agent dye-forming couplers can be incorporated to supplement silver in forming a viewable image. The dye-forming couplers can be chosen to shift image tone, particularly to produce colder overall image tones.

PREFERRED EMBODIMENTS

An exposure assembly, including a dual-coated radiographic element satisfying the requirements of the invention, is schematically illustrated as follows:

| |
|---|
| Front Screen Support (FSS) |
| Front Luminescent Layer (FLL) |
| Front Photothermographic Layer Unit (FPTLU) |
| Transparent Film Support (TFS) |
| Back Photothermographic Layer Unit (BPTLU) |
| Back Luminescent Layer (BLL) |
| Back Screen Support (BSS) |
| Assembly I |

A dual-coated photothermographic radiographic element satisfying the requirements of the invention is formed by FPTLU, TFS and BPTLU. Prior to imagewise exposure to X-radiation, the dual-coated radiographic element, a front intensifying screen, formed by FSS and FLL, and a back intensifying screen, formed by BSS and BLL, are mounted in the orientation shown in a cassette (not shown), but with the screens and film in direct contact.

X-radiation in an image pattern passes through FSS and is, in part, absorbed in FLL. The front luminescent layer re-emits a portion of the absorbed X-radiation energy in the form of a light image, which exposes one or more photothermographic layers contained in FPTLU. X-radiation that is not absorbed by the front screen passes through the dual-coated radiographic element with minimal absorption to reach BLL in the back screen. BLL absorbs a substantial portion of the X-radiation received and re-emits a portion of the X-radiation energy in the form of a light image that exposes one or more photothermographic layers contained in BPTLU.

In the simplest possible construction of the radiographic elements of this invention each of FPTLU and BPTLU is comprised of a single layer comprised of (1) a vehicle (i.e., binder and peptizer), (2) radiation-sensitive silver halide grains, (3) a light-insensitive source of silver, and (4) a reducing agent for the light-insensitive source of silver.

It is a unique feature of this invention that greater than 50 percent of the total projected area of the silver halide grains is provided by tabular grains (a) having {100} major faces, (b) containing greater than 70 mole percent chloride, based on silver, (c) exhibiting an average thickness of less than 0.3 $\mu$m, and (d) exhibiting an average equivalent circular diameter of greater than 0.6 $\mu$m.

Radiation-sensitive silver halide grains satisfying these requirements are disclosed by the following patents, the disclosures of which are here incorporated by reference: Maskasky U.S. Pat. Nos. 5,264,337, 5,292,632, 5,275,930 and 5,399,477; House et al U.S. Pat. No. 5,320,938; Brust et al U.S. Pat. No. 5,314,798; Szajewski et al U.S. Pat. No. 5,356,764; and Chang et al U.S. Pat. No. 5,413,490.

The {100} tabular grains contain greater than 70 (preferably at least 90) mole percent chloride, based on silver forming the tabular grains. The halide content of the tabular grains can consist essentially of chloride ion. Alternatively, the tabular grains can consist essentially of silver bromochlolide containing less than 30 (preferably less than 20 and optimally less than 10) mole percent bromide, based on silver forming the tabular grains. Silver iodochloride and silver iodobromochloride grains are also contemplated. It is well understood in the art that low bromide and/or iodide concentrations at grain surfaces can significantly improve the properties of the grains for photographic purposes, such as spectral sensitization. Bromide and/or iodide added for the purpose of improving sensitization can usefully be precipitated onto the surface of a previously formed tabular grain population—e.g., a silver chloride tabular grain population. Significant photographic advantages can be realized with bromide or iodide concentrations as low as 0.1 mole percent, based on total silver, with minimum concentrations preferably being at least 0.5 mole percent. Iodide concentration in the tabular grains are preferably less than 5 (optimally less than 3) mole percent, based on silver forming the tabular grains.

To realize the advantages of tabular grain shape it is contemplated that the high chloride {100} tabular grain population will be relatively thin. The tabular grain population has a mean thickness of less than 0.3 $\mu$m, and preferably less than 0.2 $\mu$m. Examples of emulsion preparations with mean tabular grain thicknesses of down to 0.033 $\mu$m are reported by House et al U.S. Pat. No. 5,320,938.

It is preferred that the tabular grain population satisfy at least the first and most preferably both of the following relationships:

(I) Average aspect ratio $ECD/t>5$ and (II) Average tabularity $ECD/t^2>25$ where ECD is the effective circular diameter of the tabular grains in micrometers ($\mu$m) and t is the thickness of the tabular grains in $\mu$m. In arriving at the average aspect ratio or average tabularity for a tabular grain population it is contemplated to average separately the ECD's and the thicknesses of the tabular grain population and then to obtain the quotient required by relationships I and II.

Average aspect ratios of the tabular grain population are limited only by the maximum ECD that can be tolerated by the photographic application contemplated. Acceptable imaging quality (granularity) for applications in which images are not enlarged can be realized with tabular grain mean ECD's ranging up to 10 $\mu$m. Mean tabular grain ECD's are typically less than 5 $\mu$m. Average aspect ratios ranging up to 50 can be readily realized, and higher average aspect ratios of up to 100 are believed to be achievable with optimized precipitations. It is specifically preferred that the tabular grain populations exhibit a high average aspect ratio—that is, greater than 8 and optimally at least 20.

The high chloride {100} tabular grains preferably exhibit high average tabularities—that is, greater than 25. Within the parameters of ECD, t and aspect ratio set forth above it is possible to provide tabular grain populations with extremely high tabularities ranging up to 1000. Typically the average tabularities are in the range of from >25 to 500, with tabularities of from 50 to 200 being most common.

High chloride {100} tabular grains account for at least 50 percent of total grain projected area. It is, of course, preferred to maximize the percentage of total grain projected area accounted for by the high chloride {100} tabular grains as the grains are initially precipitated. Thus, high chloride {100} tabular grain projected areas of greater than 70 percent and greater than 90 percent are progressively favored.

It is specifically contemplated to employ high chloride {100} tabular grains that contain one or more dopants. Illustrations of useful dopants are provided by the patents cited and incorporated by reference above to show conventional high chloride {100} tabular grain emulsions. Dopants for the high chloride {100} tabular grains are also illustrated by *Research Disclosure*, Vol. 389, September 1996, Item 38957, cited above, Section I. Emulsion grains and their preparation, D. Grain modifying conditions and adjustments, paragraphs (3) to (5).

The entire photosensitive silver halide grain population of the photothermographic layer can be formed during the precipitation of the high chloride {100} tabular grains. In this instance the composition of the entire grain population is similar, usually identical, with the grains other than {100} tabular grains being principally non-tabular grains with {100} crystal faces.

It is recognized that minor amounts of other silver halide grains, either tabular or non-tabular, can be blended with the silver halide emulsion containing the high chloride {100} tabular grains. Examples of silver halide grain blending to achieve specific photographic effects are illustrated by *Research Disclosure*, Item 38957, cited above, Section I. Emulsion grains and their preparation, E. Blends, layers and performance categories, particularly paragraph (6).

The photosensitive silver halide grains are preferably washed to remove soluble salts produced in their formation. Emulsion washing procedures are illustrated by *Research Disclosure*, Item 38957, cited above, III. Emulsion washing. The peptizers associated with the grain surfaces as precipitated remain with the grains are carried with the grains into photothermographic layer.

The photosensitive silver halide grains can be chemically and/or spectrally sensitized by any convenient conventional technique. Illustrations of useful chemical and spectral sensitizations are provided by the patents cited and incorporated by reference above to show conventional high chloride {100} tabular grain emulsions. In addition, conventional techniques for sensitizing photosensitive silver halide grains are illustrated by *Research Disclosure*, Item 38957, cited above, IV. Chemical sensitization and V. Spectral sensitization and desensitization, A. Sensitizing dyes.

In one particularly contemplated form of the invention, referred to as a Type A formulation, the photothermographic layer is comprised of (1) a vehicle, that includes as a minor component the peptizer associated with the grains in their preparation and, as a major component, a binder;

(2) photosensitive silver halide grains, including high chloride {100} tabular grains, as described above;

(3) a light-insensitive silver source; and (4) a reducing agent for the light-insensitive silver source.

The photosensitive silver halide grains can be employed in any conventional level within the photothermographic layer. As disclosed by Hanzalik et al U.S. Pat. No. 5,415,993, the silver halide grains can be present in a concentration as low as 0.01 percent by weight, based on the total weight of the photothermographic layer. It is preferred that the silver halide grains be present in a concentration of at least 5 and, optimally, at least 10 percent by weight, based on the total weight of the photothermographic layer. Silver halide grain concentrations of up to 35 percent by weight or higher, based on the total weight of the photothermographic layer are contemplated, but, for most radiographic imaging applications, it is preferred that the silver halide grains be present in concentrations of less than 25 (optimally less than 10) percent by weight, based on the total weight of the photothermographic layer.

The light-insensitive silver source can be any material that contains a source of reducible silver ions. Organic silver salts, particularly silver salts of organic acids, such as long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the photothermographic layer. It is preferably present at a level of 30 to 55 percent by weight of the photothermographic layer.

The organic silver salt is a silver salt which is comparatively stable to light, but forms a silver image when heated to 80° C. or higher in the presence of an exposed photocatalyst (i.e., the radiation-sensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S Pat. No. 3,785,830, and silver salt of an aliphatic carboxylic acid containing a thioether group as described in U.S. Pat. No. 3,330.663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, thiazole, imidazoline, imidazole, diazole, pyridine and triazine. Preferred examples of these heterocyclic compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzothiazole and a derivative thereof as described in Japanese patent publications 30270/69 and 18146/70, for example a silver salt of benzotriazole such as silver salt of methylbenzotriazole, etc., a silver salt of a halogen substituted benzotriazole, such as a silver salt of 5-chlorobenzotriazole, etc., a silver salt of 1,2,4-triazole, of 1H-tetrazole as described in U.S Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* October 1983 (23419) and U.S. Pat. No. 3,985,565.

The radiation-sensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The reducing agent for the organic silver salt may be any material, preferably organic material, that can reduce silver ion to metallic silver. Conventional photographic developers, such as 3-pyrazolidinones, hydroquinones, and catechol are useful, but hindered phenol reducing agents are preferred. Where dye-forming couplers are incorporated, the reducing agent preferably takes the form of a conventional color developing agent, such as a p-phenylenediamine. The reducing agent is preferably present in a concentration ranging from 5 to 25 percent of the photothermographic layer.

Wide ranges of reducing agents have been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); substituted phenols and naphthols, such as bis-β-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, Item 17029, cited above.

Combinations of reducing agents are also useful, such as, a combination of aliphatic carboxylic acid aryl hydrazides and ascorbic acid, such as 2,2'-bis(hydroxymethyl) propionylbetaphenyl hydrazide in combination with ascorbic acid; a combination of polyhydroxybenzene and hydroxylamine, a reductone and a hydrazine, e.g., a combination of hydroquinone and bis(ethoxyethyl) hydroxylamine; and a combination of azines and sulfonamidophenols.

Using developing agent, including color developing agents are *Research Disclosure*, Item 38957, cited above, XIX. Development, A. Developing Agents.

The thermally processable elements as described preferably contain various colloids and polymers alone or in combination as vehicles (peptizers and binders) and in various layers. Useful vehicles can be either hydrophilic or hydrophobic. They are transparent or translucent and include both naturally occurring substances, such as gelatino-hydrophilic colloids (gelatin and gelatin derivatives), cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoaciylates, and those that have cross-linking sites. Preferred high molecular weight materials and resins include poly(vinyl acetals)—e.g., poly (vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. To optimally balance physical properties the polymers usually contain combinations of vinyl repeating units. Exemplary vehicles are disclosed in *Research Disclosure* Item 38957, cited above, II. Vehicles, vehicle extenders, vehicle-like addenda and vehicle related addenda, and *Research Disclosure* Item 17029, cited above, XIII. Vehicles and/or binders.

Although not essential, it is conventional practice to coat a layer of vehicle over the photothermographic layer or layers of a layer unit to provide a protective overcoat. Any of the same vehicles described above for incorporation in the emulsion layer can be employed. The protective overcoat additionally provides a convenient site for the incorporation of addenda that are intended to modify the physical properties of the coatings. Examples of preferred overcoat layers are provided by *Research Disclosure* Item 17029, XI. Overcoated layers.

The photothermographic layer or layers and protective overcoat, when present, can contain addenda that are known to aid in formation of a useful image. These layers can contain development modifiers that function as speed increasing compounds, sensitizing dyes, hardeners, antistatic agents, anti-matting agents (also referred to as matting agents), plasticizers and lubricants, and coating aids. Such addenda are illustrated by *Research Disclosure*, Item 38957, cited above, IX. Coating physical property modifying addenda, A. Coating aids, B. Plasticizers and lubricants, C. Antistats and D. Matting Agents and by *Research Disclosure*, Item 17029, cited above, X. Coating Aids.

It is specifically contemplated to employ organo-gel binders of the type disclosed by Hanzalik et al PCT WO 94/25900 and U.S. Pat. No. 5,415,993, the disclosure of which is here incorporated by reference.

The binders are employed in any convenient concentration for dispersing the components contained therein. Typically a preferred ratio of the binder to the light-insensitive, reducible silver source ranges from 15:1 to 1:2, most typically from 8:1 to 1:1. Since the binder and the light-insensitive, reducible silver source constitute the two highest concentration components of the photothermographic layer, it is preferred that these materials be chosen for maximum compatibility with this component. For example, whereas the light-insensitive, reducible silver source is a relatively hydrophilic material, such silver salts of compounds containing mercapto or thione groups, a hydrophilic colloid binder is favored, whereas, when the light-insensitive, reducible silver source is a more hydrophobic material, such as a silver soap or half soap—e.g., silver behenate, a synthetic resin binder, such as a vinyl acetal polymer or copolymer, is preferred.

In addition to the essential components of the Type A formulation described above, it is appreciated that various optional components can additionally be present. In forming viewable silver images tone modifiers, such as those illustrated by *Research Disclosure*, Item 17029, cited above, V. Tone Modifiers, are particularly important to modifying silver particle formation during development and hence providing a more uniform and pleasing image tone.

Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine tlifluoroacetate; mercaptans as illustrated by 3-mercapto-1,2,4-triazole, 2,4-dimercaptopyrimidine, 3-mercapto-4,5-diphenyl- 1,2,4-triazole and 2,5-dimercapto- 1,3,4-thiadiazole; N-(aminomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolinylidene)-1-methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimides, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator-Stabilizers/Stabilizers, A. Activators and Activator Precursors, B. Stabilizers and Stabilizer Precursors, and C. Activator/Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Upon imagewise exposure and thermal processing the Type A formulations described above produce a retained negative silver image. It has been discovered quite unexpectedly that, when high chloride {100} tabular grains satisfying the requirements described above are employed, superior image discrimination is obtained. Surprisingly, image discrimination is much larger when high chloride {100} tabular grain emulsions are employed than when high bromide tabular grain emulsions, with or without iodide, are employed. Still more surprising, high chloride {100} tabular grain emulsions produce much higher levels of image discrimination than high chloride {111} tabular grain emulsions.

It has also been observed that reduced light scattering is produced by the high chloride tabular grains than by the high bromide tabular grains.

As variations of the Type A formulations above, hereinafter referred to as a Type D formulations, the reducing agent can be chosen to form a dye image. For example, where the incorporated reducing agent is a color developing agent, it can react with a dye-forming coupler to produce an azo dye image. Particularly useful color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate. Other p-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Dye-forming couplers useful with color developing agents are illustrated by *Research Disclosure*, Item 38957, cited above, X. Dye image formers and modifiers, B. Image-dye-forming couplers.

Leuco dyes are another class of reducing agents that form a dye image upon oxidation. The leuco dye can be any colorless or slightly colored compound that can be oxidized to a colored form, when heated, preferably to a temperature of from about 80° to 250° C. for a duration of from 0.5 to 300 seconds. Any leuco dye capable of being oxidized by silver ion to form a visible image can be used.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes". These dyes are prepared by oxidative coupling of a p-phenylenediamine with a phenolic or anilinic compound. Leuco dyes of this class are described in U.S. Pat. No. 4,594,307.

A third class of dyes useful in this invention are "aldazine" and "ketazine" dyes. Dyes of this type or described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type ore described in Japanese Pat. No. 52-89131 and U.S. Pat. Nos. 2,784,186; 4,439,280; 4,563,415; 4,570,171; 4,622,395 and 4,647,525, all of which are incorporated hereby by reference.

Other illustrations of color materials are set out in *Research Disclosure*, Item 17029, cited above, XV. Color materials. Various conventional components that are employed in combination with dye image formers can additionally be present in the photothermographic layer. Such components include those set out in *Research Disclosure*, Item 38957, cited above, X. Dye image modifiers and addenda, C. Image dye modifiers, D. Hue modifiers/stabilization, and E. Dispersing dyes and dye precursors. Dye image stabilizers, such as those set out in paragraph (3) of section D, are particularly preferred components.

In the dual-coated radiographic elements of the invention black images are formed, preferably black images with "cold" (blue-black) image tones. Developed silver is black and can alone satisfy image density requirements. When dyes are employed, they are preferably used to supplement the silver in satisfying maximum density requirements. Thus, when dyes are employed, it is preferred to employ combinations of dyes that together with developed silver provide neutral black, preferably "cold" black images. It is also possible to generate image dye during development that is blue for the purpose of providing a colder overall image tone.

For diagnostic radiographic elements it is preferred that sufficient silver and dye, if relied upon to supplement the silver image, be formed by processing to produce a maximum density of at least 3.0 and, preferably, at least 4.0. Increasing maximum densities beyond about 4.5 serves no useful purpose.

The photothermographic layer units preferably contain a dye to reduce crossover. In a single layer photothermographic layer unit the crossover control dye must of necessity be incorporated in the photothermographic layer. To avoid reductions in imaging speed and to achieve maximum image sharpness it is preferred to locate the crossover control dye in a separate layer coated between the photothermographic layer and the support. Suitable dyes are disclosed in *Research Disclosure*, Item 17029, cited above, XIV. Filter Dyes/Antihalation Layers. It is particularly preferred to employ a formazan dye in combination with a hexaarylbiimidazole, as taught by Levinson et al U.S. Pat. No. 4,201,590, the disclosure of which is here incorporated by reference. The hexaarylbiimidazole facilitates thermal bleaching of the formazan dye. When an underlayer is provided, it contains a binder compatible with the photothermographic layer and usually employs the same binder. It is recognized that various of the optional addenda described above for incorporation in the photothermographic layer can be shifted in whole or in part to the underlayer.

The support TFS can take the form of any conventional transparent support that is capable of retaining dimensional integrity when heated to contemplated thermal processing temperatures. Preferred supports are transparent polymeric supports that exhibit glass transition temperatures ($T_g$) above about 190° C. and preferably above 200° C.

Dual-coated radiographic element supports capable of withstanding at least the minimum contemplated levels of heating during processing are contemplated for use. The supports of dual-coated radiographic elements are transparent, typically clear (colorless) or blue-tinted transparent supports. To avoid excess minimum densities, blue tinting is limited so that the support has an overall neutral density of less than 0.25. A thermally stable dye, such as, anthraquinone, is conventionally incorporated into radiographic supports prior to extrusion or casting. Preferred conventional radiographic element supports are polyester supports, such as poly(ethylene terephthalate) and poly (ethylene 1,4-naphthalate). The polymer and dye components of conventional radiographic supports for dual-coated elements are disclosed in *Research Disclosure* Item 18431, cited above, XII. Film Supports.

Alternatively and preferably, TFS can take the form of a conventional transparent photothermographic film support. Such supports are disclosed in *Research Disclosure* Item 17029, cited above, XVII. Supports B. Film Supports. In this invention conventional transparent photothermographic film supports are preferably modified by incorporating a blue tinting dye of the type cited above (preferably anthraquinone) as conventionally incorporated in dual-coated radiographic film supports.

The front and back intensifying screens in Assembly I can take any convenient conventional form. The intensifying screens are separated from the dual-coated radiographic film before thermal processing of the film. Hence, no modification of conventional intensifying screens employed to exposed aqueous processed radiographic elements is required. Examples of conventional, useful fluorescent intensifying screens are provided by *Research Disclosure*, Item 18431, cited above, Section IX. X-Ray Screens/Phosphors, and Bunch et al U.S. Pat. No. 5,021,327 and Dickerson et al U.S. Pat. Nos. 4,994,355, 4,997,750, and 5,108,881, the disclosures of which are here incorporated by reference.

Typically the supports FSS and BSS are reflective or transparent film support, preferably the former. If a reflective (e.g., white) support is incorporated in each of the fluorescent intensifying screens, a higher proportion of emitted light reaches the radiographic element.

FLL and BLL, the fluorescent layers, each contain phosphor particles and a binder, optimally additionally containing a light scattering material, such as titania. Higher emission efficiencies are realized with phosphors such as calcium tungstate ($CaWO_4$), niobium and/or rare earth activated yttrium, lutetium or gadolinium tantalates, and rare earth activated rare earth oxychalcogenides and halides.

The rare earth oxychalcogenide and halide phosphors are preferably chosen from among those of the following formula:

$$M_{(w-n)}M'_nO_wX \quad \text{(III)}$$

wherein

M is at least one of the metals yttrium, lanthanum, gadolinium or lutetium,

M' is at least of the rare earth metals, preferably dysprosium, erbium, europium, holmium, neodymium, praseodymium, samarium, terbium, thulium, or ytterbium, X is a middle chalcogen (S, Se or Te) or halogen, n is 0.002 to 0.2, and w is 1 when X is halogen or 2 when X is chalcogen.

In use, a dual-coated photothermographic radiographic film satisfying the requirements of the invention is mounted between a pair of conventional front and back intensifying screens as shown in Assembly I in preparation of imagewise exposure. Thereafter, X-radiation in the 25 to 125 kVp energy range that has been imagewise modulated in transmission through a subject is received by the front intensifying screen. A substantial portion, typically from 10 to 50 percent of the X-radiation, is absorbed in the front luminescent layer FLL, which in turn emits light that exposes the front photothermographic layer unit FPTLU. It is this light exposure that is primarily responsible for latent image formation in the FPTLU.

The X-radiation that is not absorbed by FLL penetrates to FPTLU, where a small fraction (typically less than 2 percent) of the total X-radiation incident upon the assembly is absorbed. The remaining X-radiation penetrates the transparent support TFS and reaches the back photothermographic layer unit BPTLU, where another small fraction (typically less than 2 percent) of the total X-radiation incident upon the assembly is absorbed.

BLL of the back intensifying screen provides the final X-radiation capture opportunity. Typically at least 50 percent of the total X-radiation reaching the assembly is captured by the back intensifying screen. The light emitted by the back intensifying screen is primarily responsible for forming a latent image in the back photothermographic layer unit BPTLU.

Preferably the dual-coated radiographic element is constructed so that crossover is either minimized or essentially eliminated. Crossover levels of less than 25 percent are generally contemplated, with crossover levels of less than 10 percent being preferred. Conventional dual-coated radiographic elements often reduce crossover below measurable levels. In terms of ASSEMBLY I crossover minimization means that the proportion of light emitted by FLL and BLL reaching the radiation-sensitive grains in BPTLU and FPTLU, respectively, is minimized and, ideally, reduced below measurable levels.

To convert the latent images within the dual-coated radiographic element to a viewable image, the dual-coated element is removed from ASSEMBLY I and heated overall to convert thermally silver ion within the photothermographic layers to metallic silver. In the course of this development a supplemental dye image can also be formed. Overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is possible. A preferred thermal processing temperature is within the range of about 100° C. to about 140° C.

Any conventional heating means for photothermographic elements can be employed. For example, heating means such as a simple hot plate, iron, roller, heated drum, microwave heating unit, and heated air, are all contemplated.

Thermal processing is preferably carried out under ambient conditions of pressure and humidity, but both pressure and humidity variations can be employed, if desired.

EXAMPLES

The invention can be better appreciated by reference to the following specific embodiments:

Emulsion E-1

(a control emulsion)

This emulsion was prepared to compare the performance of a high bromide {111} tabular grains with radiation-sensitive silver halide grains satisfying the requirements of the invention.

Solution A-1: 1M silver nitrate

Solution A-2: 2.5M silver nitrate

Solution A-3: 2.6M sodium bromide

The emulsion was precipitated in the following manner: 22.1 g lime processed bone gelatin and 33 g sodium bromide were dissolved in 5.5 L distilled water at 76.7° C. To this solution with vigorous stirring were added via the double jet method over 1.7 minutes solution A-1 and solution A-3 at 54 and 24.8 cc/min respectively. Then, a solution containing 3.4 L distilled water and 83.5 g gelatin was added all at once and held for 3 minutes. Growth was continued at a pAg of 8.6 via the double jet technique with solutions A-2 and A-3 for 20.8 minutes consuming 15.3 percent of the total silver. The pAg was then shifted to 7.9 with the same solutions over 4.9 minutes. Solution A-2 was added via accelerated flow rate starting at 29.8 cc/min over 30 minutes using solution A-3 as the double jet salt, precipitating 33.2 percent additional silver. The final 47 percent of the silver was precipitated under the same double jet conditions over 31.9 minutes. The emulsion was then cooled and desalted.

A total of 10.1 moles of silver bromide was precipitated, resulting in a tabular grain emulsion in which the tabular grain exhibited {111} major faces. The emulsion grains exhibited a mean equivalent circular diameter of 1.8 $\mu$m and a mean thickness of 0.13 μm. Tabular grains accounted for greater than 90 percent of the total grain projected area.

The emulsion was spectrally sensitized with green sensitizing dye anhydro-5,5'-dichloro-9-ethyl-3,3'-bis(3-sulfopropyl)oxacarbocyanine hydroxide, sodium salt, (Dye 1) and optimally sulfur and gold sensitized using potassium tetrachloroaurate (III), sodium thiosulfate, potassium iodide, potassium selenocyanate, anhydro-5,6-dimethyl-3(3-sulfopropyl)benzothiazolium, and sodium thiocyanate.

Emulsion E-2

(an example emulsion)

This emulsion was prepared to provide high chloride {100} tabular grains.

Solution B-1: 4M silver nitrate, $3.2\times10^{-4}$ gm/L mercuric chloride

Solution B-2: 4M sodium chloride, 0.26 gm/L potassium hexacyanoruthenate

Solution B-3: 3.72M sodium chloride, 0.28M potassium iodide

The emulsion was precipitated in the following manner: 195 g oxidized lime-processed bone gelatin and 13 g sodium chloride were dissolved in 4.37 L distilled water at 35° C. To this solution with vigorous stirring were added via the double jet method over 1 minute 1M silver nitrate and 4M sodium chloride at 78 and 20.5 cc/min respectively. Then, a solution containing 9.27 L distilled water and 2.25 g sodium chloride and 0.65 gm potassium iodide was added all at once and held for 5 minutes. While the temperature was ramped to 36.5° C., solutions B-1 and B-2 were added over 2 minutes bringing the pAg to 6.95. The temperature was ramped a second time to 50° C. over 18 minutes while the double jet addition of solutions B-1 and B-2 was continued, precipitating 13.4 percent of the total silver and adjusting the pAg to 6.6. The temperature was ramped a third time to 70° C. over 20 minutes while another 18.6 percent of the silver was precipitated with the same solutions, adjusting the pAg to 6.45. The vessel contents were then held under the present conditions for 15 minutes, after which growth was continued for the next 37.4 minutes via the double jet method and precipitating 49.8 percent of the total silver. The emulsion was then ripened for 30 minutes. Finally, solutions B-1 and B-3 were added over 15.2 minutes at 20 cc/min. The emulsion was then cooled and desalted.

The precipitation produced silver halide grains contains a total of 8.05 moles of silver and resulted in high chloride tabular grains having {100} major faces. The grains exhibited a equivalent circular diameter of 2.0 μm and a mean thickness of 0.15 μm. Tabular grains accounted for more than 70% of the total grain projected area.

The emulsion was spectrally sensitized with green sensitizing dyes anhydro-3,9-diethyl-3'-methylsulfonylcarbamoylmethyl-5-phenyloxathiocarbocyanine hydroxide (Dye 2) and anhydro-5-chloro-9-ethyl-5'-phenyl-3'-(3-sulfobutyl)-3-(3-sulfopropyl)oxacarbocyanine hydroxide, sodium salt, (Dye 3) and optimally sulfur and gold sensitized using potassium tetrachloroaurate (III), sodium thiosulfate, and 1-(3-acetamidophenyl)-5-mercaptotetrazole.

Emulsion E-3

(a control emulsion)

An AgICl {111} tabular grain emulsion was prepared in the following manner:

To a well stirred reaction vessel at 50° C. were added 9.3 g of NaCl, 80 g of lime processed bone gelatin, 3.9 L of water, and a solution containing 2.84 g of 7-azaindole with a pH of 2.5. The pH of the reaction vessel was then adjusted to 5.5. Grain nucleation was accomplished by a single-jet addition of 2M $AgNO_3$ at a rate of 8 mL/min for 0.6 minute.

Immediately following nucleation the growth stages listed in Table I were conducted by adding as a second jet 4M NaCl while maintaining the pCl of the reaction vessel at 1.5. The $AgNO_3$ solution concentrations flow rates and times for the growth stages are listed in Table I.

TABLE I

| Growth Segment | $AgNO_3$ Conc. (molar) | Initial Flow mL/min | Final Flow mL/min | Time minutes |
|---|---|---|---|---|
| I | 2 | 8 | 16 | 2.8 |
| II | 4 | 8 | 30 | 15 |
| III | 4 | 30 | 30 | 14 |

After a 1 minute hold 4M $AgNO_3$ was run into the reaction vessel at 23 mL/min for 2.4 minutes while the pCl was maintained at 1.5 using a solution that is 3.6M in NaCl and 0.4M in KI.

At the conclusion of grain growth the emulsion was washed and concentrated. The resulting AgICl {111} tabular grain emulsion exhibited a mean grain ECD of 0.86 μm and a mean grain thickness of 0.1 μm. Tabular grains accounted for greater than 90 percent of total grain projected area. The halide content of the grains was 0.70 mole percent iodide and 99.3 mole percent chloride, based on total silver. The emulsion was spectrally sensitized with Dye 3. The emulsion was optimally sulfur and gold sensitized using potassium tetrachloroaurate(III) and sodium thiosulfate.

Emulsion E-4

(an example emulsion)

A high chloride AgICl {100} tabular grain emulsion was prepared in the following manner:

To a well stirred reaction vessel at 35° C. were added 1.48 g of NaCl, 38.8 g of an oxidized lime processed bone gelatin, 0.28 g of KI, and enough water to bring the final volume to 4.5 liters. Grain nucleation was accomplished by the simultaneous addition of SOLN-1, 4M $AgNO_3$ that contained 0.32 g/L of $HgCl_2$, and 4M NaCl, both at rates of 21 mL/min for 0.5 minute.

Immediately following nucleation, 9.1 L of a solution containing 0.39 g/L NaCl and 0.12 g/L of KI were added to the reaction vessel. This mixture was held for 8 minutes. Grain growth was then undertaken by adding SOLN-1 at the flow rates and times listed in Table II. The pCl of the reaction vessel was maintained at 2.2 by the simultaneous addition of 4M NaCl.

TABLE II

| Growth Segment | Initial Flow mL/min | Final Flow mL/min | Segment Time minutes |
|---|---|---|---|
| I | 14 | 14 | 5 |
| II | 14 | 42 | 52 |

At the conclusion of growth segment II, a 4M solution of NaCl was run into the reaction vessel at 14 mL/min for 5 minutes, followed by a hold for 30 minutes. Thereafter SOLN-1 was run into the reaction vessel at 14 mL/min for 5 minutes, followed by the addition of 70 mL of a solution containing 5.25 g of KI. After a 20 minute hold, a final growth segment was performed by the 8 minute addition of 14 mL/min of SOLN-1, with the simultaneous addition of the 4M NaCl solution to maintain the pCl at 2.2.

At the conclusion of grain growth the emulsion was washed and concentrated. The resulting high chloride {100} tabular grain emulsion exhibited a mean grain ECD of 0.56 μm and a mean grain thickness of 0.09 μm. Tabular grains accounted for greater than 70 percent of total grain projected area. The halide content of the grains was 0.6 mole percent iodide and 99.4 mole percent chloride. based on total silver. The emulsion was spectrally sensitized with a 6:1 molar ratio of Dye 3:Dye 2. The emulsion was optimally sulfur and gold sensitized using potassium tetrachloroaurate(III) and sodium thiosulfate.

Example 1

This example compares the performance of emulsions E-1 and E-2 in dual-coated radiographic elements containing photothermographic layers that are coated using non-aqueous solvents.

Non-aqueous solvent photothermographic coating compositions were prepared using a solvent mixture containing methyl iso-butyl ketone and toluene. To incorporate the grains of each Emulsions E-1 and E-2 separately into the coating compositions, an emulsion solvent was produced containing 6.25% benzyl alcohol and 4.69% poly (vinyl butyral) in toluene, the percentages being weight percentages, based on total weight. An ultrasonic probe capable of delivering 50 W was placed into a stirred 44 g sample of the emulsion solvent. Ultrasonic energy was applied to the emulsion solvent while 0.016 mole of a melted sample of one of emulsions E-1 or E-2 was added, followed by 9 additional minutes of sonification. This resulted in a suspension of the silver halide grains in the coating solvent.

Elements were prepared by coating a single photothermographic layer in a dual-coated (Duplitized ™) format on each side of a transparent film support. Each of the photothermographic layers contained 116.9 mg/dm$^2$ of poly(vinyl butyral) binder, 14.2 mg/dm$^2$ of silver provided by the silver halide grains, and 21.7 mg/dm$^2$ of silver provided by silver behenate, as a light insensitive source of silver. In addition these coatings contained N-(4-hydroxyphenyl) benzenesulfonamide as a reducing agent and succinimide as a development accelerator at coating levels of 53.2 and 14.9 mg/dm$^2$ respectively.

To simulate intensifying screen exposure, each coating was exposed by a 2850° K. light source through a step wedge and a Coining™ 4010 green filter, which allows transmission of light within wavelengths between 420 and 680 nm, for 5 seconds, followed by thermal processing for 2 seconds at 132° C.

The performance of the photothermographic coatings prepared with emulsions E-1 and E-2 is summarized in Table III

TABLE III

| Coating | Emulsion | $D_{min}$ | $D_{max}$ | ID* |
|---|---|---|---|---|
| 1 | E-1 | 0.60 | 0.93 | 0.33 |
| 2 | E-2 | 0.21 | 0.77 | 0.56 |

*ID = $D_{max} - D_{min}$

From a comparison of the data in Table III it is apparent that the highest levels of image discrimination ($D_{max}$–$D_{min}$) were achieved employing the high chloride {100} tabular grains provided by emulsion E-2. In addition, emulsion E-2 provided a much lower $D_{min}$.

These advantages of high chloride {100} tabular grains over high bromide {111} tabular grains are not observed in aqueous processed photographic or radiographic elements. These advantages of high chloride {100} tabular grains in the photothermographic layer units of the radiographic element of this example were unexpected, but highly desirable in terms of producing improved radiographic images while avoiding aqueous processing.

Example 2

This example compares the performance of emulsions E-1 and E-2 in dual-coated radiographic elements containing photothermographic layers that are coated using aqueous solvents.

Aqueous photothermographic compositions were coated on each major face of a transparent film support using gelatin as a binder and a mixture of dye-forming couplers in order to supplement silver in providing a neutral tone scale.

Each aqueous photothermographic composition contained 43.0 mg/dm$^2$ of gelatin, 2.42 mg/dm$^2$ of the cyan dye-forming coupler C-1, 1.72 mg/dm$^2$ of the magenta dye-forming coupler M-1, 1.24 mg/dm$^2$ of the yellow dye-forming coupler Y-1, 10.2 mg/dm$^2$ of the radiation-insensitive silver salt of 3-amino-5-benzylmercapto-1,2,4-triazole, and silver levels provided by silver halide grains as listed in Table IV.

TABLE IV

| Element | Emulsion | Silver Halide, mg/dm$^2$ |
|---|---|---|
| 1 | E-1 | 10.8 |
| 2 | E-2 | 10.8 |
| 3 | E-1 | 21.5 |
| 4 | E-2 | 21.5 |

A protective overcoat located on each photothermographic layer contained 16.1 mg/dm$^2$ gelatin and 10.2 mg/dm$^2$ of the reducing agent 2-[(4-amino-3-methylphenyl) ethylamino]ethanol sulfate, a color developing agent.

C-1

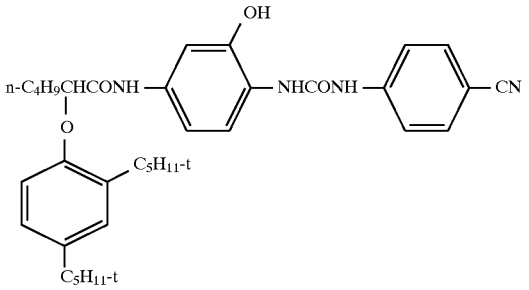

M-1

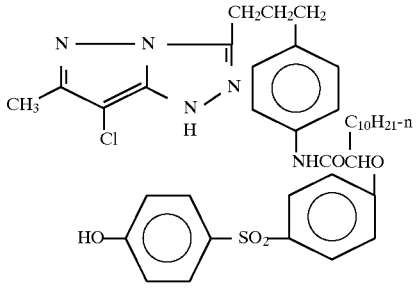

-continued

Y-1

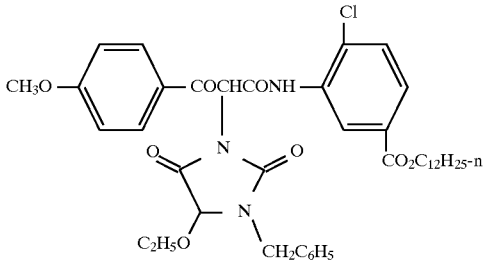

Each element received a simulated intensifying screen exposure by exposure with a 2850° K. light source that was filtered by a Corning™ 5900 filter in order to simulate a 5500° K. light source. The exposure took place for 10 seconds through a step wedge, and was followed by thermal processing at 128° C. for 2 seconds in order to reveal an image.

The performance of the photothermographic coatings with varying levels of E-1 and E-2 is summarized in Table V.

TABLE V

| Element | Emulsion | $D_{min}$ | $D_{max}$ | ID* |
|---|---|---|---|---|
| 1 | E-1 | 1.81 | 2.67 | 0.86 |
| 2 | E-2 | 1.14 | 2.53 | 1.39 |
| 3 | E-1 | 2.17 | 3.99 | 1.82 |
| 4 | E-2 | 1.56 | 3.56 | 2.00 |

*ID = $D_{max} - D_{min}$ $D_{min}$ and $D_{max}$ values were obtained from Status M green density. It is apparent that the high chloride {100} tabular grains provided the lowest levels of $D_{min}$ and the highest levels of image discrimination ($D_{max}$–$D_{min}$).

These advantages of high chloride {100} tabular grains over high bromide {111} tabular grains are not observed in aqueous processed photographic or radiographic elements. These advantages of high chloride {100} tabular grains in the photothermographic layer units of the radiographic element of this example were unexpected, but highly desirable in terms of producing improved radiographic images while avoiding aqueous processing.

Example 3

This example has as its purpose to demonstrate the light capture and thermal bleaching characteristics of a crossover reducing layer that can be incorporated in a dual-coated radiographic element satisfying the requirements of the invention.

Layers 1 and 2 were coated successively onto a transparent film support. Coating coverages are in mg/dm$^2$ and emulsion coverages are based on the weight of silver. Layer 1, the crossover control layer, was coated out of a mixed solvent (60% acetone and 40% methyl iso-butyl ketone) while the photothermographic layer was coated as an aqueous composition.

| Layer 1 Crossover Control Layer | |
|---|---|
| Poly(vinyl butyral) | 122 |
| Formazan dye D-1 | 10.2 |
| H-1 | 30.5 |

Formazan dye D-1 was 5-(benzothiazol-2-yl)-3-(3-methoxyphenyl)-1-(4-nitrophenyl)formazan H-1 was 4,5-diphenyl-2-(4-methoxyphenyl)-1-[4,5-diphenyl-2-(4-methoxydiphenyl)imidazol-2-yl]imidazole -continued

| Layer 2 Photothermographic layer | |
|---|---|
| Emulsion E-2 | 10.8 |
| Dye-forming coupler M-1 | 8.6 |
| Silver salt of 3-amino-5-benzylmercapto-1,2,3-triazole | 10.8 |
| 2-[(4-amino-3-methylphenyl)ethylamino]ethanol sulfate | 10.8 |
| Gelatin | 61.0 |

A simulated intensifying screen exposure was undertaken as in Example 1, except that one sample of the film was exposed from above the Layer 2 while a second sample of the film was exposed through the transparent film support, so that light was forced to penetrate the crossover control layer before reaching the photothermographic layer.

After exposure the coated samples were thermally processed for 2 seconds at 130° C.

Sensitometric analysis showed that the sample exposed through the film support and crossover control layer was 0.8 log E (where E represents exposure in lux-seconds) slower than the sample exposed from above Layer 2. This demonstrated that the Layer 1 was functioning to absorb exposing light and that it was capable of reducing crossover to levels well below 20 percent.

After thermal processing the formazan dye was decolorized, demonstrating its utility for use in a crossover control layer.

Example 4

This example has as its purpose to compare the performance of high chloride {100} and {111} tabular grain emulsions.

Photothermographic coating compositions were prepared using a solvent mixtule containing methyl iso-butyl ketone and toluene. To incorporate the grains of each Emulsions 1 through 4 separately into coating compositions, an emulsion solvent was produced containing 6.25% benzyl alcohol and 4.69% of poly(vinyl butyral) in toluene, the percentages being weight percentages, based on total weight. An ultrasonic probe capable of delivering 50 W was placed into a stirred 44 g sample of the emulsion solvent. Ultrasonic energy was applied to the emulsion solvent while 0.015 mole of a melted sample of one of Emulsions 1 through 4 was added, followed by 9 additional minutes of sonification. This resulted in a suspension of the silver halide grains in the coating solvent.

Elements were prepared by coating a single photothermographic layer on a transparent film support. Each of the photothermographic layers contained 37.5 mg/dm$^2$ of poly (vinyl butyral) binder, 5.0 mg/dm$^2$ of silver provided by the silver halide grains, and 7.0 mg/dm$^2$ of silver provided by silver behenate, as a light insensitive source of silver. In addition these coatings contained N-(4-hydroxyphenyl) benzenesulfonamide (DEV-1) as a developing agent and succinimide (ACC-1) as a development accelerator. The concentrations of DEV-1 and ACC-1 were varied as shown below.

Each coating was exposed by a 5500° K. light source through a step wedge and a Kodak Wratten™ 9 filter, which allows transmission at wavelengths longer than 460 nm, for 0.01 second, followed by thermal processing for 2 seconds at 128° C.

The performance of coatings prepared with the high chloride {111} tabular grains of Emulsion E-3 is summarized in Table VI.

TABLE VI

| DEV-1 mg/dm$^2$ | ACC-1 mg/dm$^2$ | $D_{min}$ | $D_{max}$ | $D_{max} - D_{min}$ |
|---|---|---|---|---|
| 14.3 | 3.2 | 0.19 | 0.52 | 0.33 |
| 14.3 | 4.8 | 0.27 | 0.64 | 0.37 |
| 14.3 | 6.5 | 0.24 | 0.60 | 0.36 |
| 17.0 | 3.2 | 0.27 | 0.50 | 0.23 |
| 17.0 | 4.8 | 0.18 | 0.38 | 0.20 |
| 17.0 | 6.5 | 0.69 | 0.77 | 0.08 |

The performance of coatings prepared with the high chloride {100} tabular grains of Emulsion E-4 is summarized in Table VII.

TABLE VII

| DEV-1 mg/dm$^2$ | ACC-1 mg/dm$^2$ | $D_{min}$ | $D_{max}$ | $D_{max} - D_{min}$ |
|---|---|---|---|---|
| 9.6 | 3.2 | 0.19 | 0.70 | 0.51 |
| 9.6 | 4.8 | 0.18 | 0.83 | 0.65 |
| 9.6 | 6.5 | 0.22 | 1.02 | 0.80 |
| 14.5 | 3.2 | 0.19 | 0.95 | 0.76 |
| 14.5 | 4.8 | 0.21 | 0.95 | 0.72 |
| 14.5 | 6.5 | 0.21 | 0.93 | 0.79 |
| 17.2 | 3.2 | 0.21 | 1.00 | 0.81 |
| 17.2 | 4.8 | 0.21 | 1.02 | 0.77 |

TABLE VII

| DEV-1 mg/dm$^2$ | ACC-1 mg/dm$^2$ | $D_{min}$ | $D_{max}$ | $D_{max} - D_{min}$ |
|---|---|---|---|---|
| 17.2 | 6.5 | 0.21 | 0.98 | 0.79 |
| 19.9 | 3.2 | 0.23 | 0.97 | 0.74 |
| 19.9 | 4.8 | 0.25 | 1.01 | 0.76 |
| 19.9 | 6.5 | 0.22 | 0.99 | 0.77 |

From a comparison of Tables VI and VII, it is apparent that higher levels of image discrimination ($D_{max}$–$D_{min}$) were achieved employing the high chloride {100} tabular grains provided by Emulsion E-4. This establishes an unexpected advantage for these emulsions in photothermographic layers.

The invention has been described in detail with particular reference to preferred embodiments thereof but it will be understood that variations and modifications can be effected within the spirit and scope of the invention.

What is claimed is:

1. A dual-coated medical diagnostic radiographic element capable of producing a viewable image when heated following imagewise exposure comprised of a transparent film support having first and second major surfaces and, coated on each of said major surfaces, a layer unit for producing a viewable silver image following imagewise exposure and processing, WHEREIN each layer unit is comprised of a vehicle, radiation-sensitive silver halide grains, a light-insensitive source of silver, and a reducing agent for said light-insensitive reducible source of silver, greater than 50 percent of total projected area of said silver halide grains being provided by tabular grains having {100} major faces, containing greater than 70 mole percent chloride, based on silver, exhibiting an average thickness of less than 0.3 $\mu$m, and exhibiting an average equivalent circular diameter of greater than 0.6 $\mu$m.

2. A dual-coated medical diagnostic radiographic element according to claim 1 wherein the tabular grains account for greater than 90 percent of total grain projected area.

3. A dual-coated medical diagnostic radiographic element according to claim 1 wherein the tabular grains contain greater than 90 mole percent chloride, based on total silver.

4. A dual-coated medical diagnostic radiographic element according to claim 1 wherein the light-insensitive source of silver is a silver carboxylate.

5. A dual-coated medical diagnostic radiographic element according to claim 4 wherein the silver carboxylate is silver behenate.

6. A dual-coated medical diagnostic radiographic element according to claim 1 wherein the vehicle is comprised of a poly(vinyl acetal).

7. A dual-coated medical diagnostic radiographic element according to claim 6 wherein the poly(vinyl acetal) contains repeating units formed by the polymerization of vinyl butyral.

8. A dual-coated medical diagnostic radiographic element according to claim 1 wherein the light-insensitive source of silver is a silver salt of a mercapto or thione substituted compound.

9. A dual-coated medical diagnostic radiographic element according to claim 8 wherein the silver salt is a silver salt of 3-amino-5-benzylmercapto-1,2,3-triazole.

10. A dual-coated medical diagnostic radiographic element according to claim 1 wherein the vehicle is comprised of a gelatino-hydrophilic colloid.

11. A dual-coated medical diagnostic radiographic element according to claim 1 wherein the reducing agent is a silver halide developing agent.

12. A dual-coated medical diagnostic radiographic element according to claim 11 wherein the developing agent is a color developing agent and the layer units additionally contain at least one dye-forming coupler.

13. A dual-coated medical diagnostic radiographic element according to claim 12 wherein the dye-forming coupler is chosen to shift the overall image produced on heating to colder image tones.

14. A dual-coated medical diagnostic radiographic element according to claim 12 wherein the layer units additionally contain a combination of dye-forming couplers capable of reacting with oxidized color developing agent to produce a combination of dyes creating a black dye image.

15. A dual-coated medical diagnostic radiographic element according to claim 1 including a thermally decolorizable dye interposed between the radiation-sensitive silver halide grains in at least one of the layer units and the support.

16. A dual-coated radiographic element according to claim 15 wherein the thermally decolorizable dye is a formazan dye.

17. A dual-coated medical diagnostic radiographic element comprised of a transparent film support having first and second major surfaces and, coated on each of said major surfaces, a layer unit for producing a viewable silver image following image exposure and processing containing radiation-sensitive silver halide grains, silver behenate, a silver halide developing agent, and a binder comprised of a polymer containing repeating units formed by the polymerization of vinyl butyral, the radiation-sensitive silver halide grains including tabular grains having {100} major faces, containing greater than 90 percent chloride, based on silver, accounting for greater than 90 percent of total silver halide grain projected area, and exhibiting an average thickness of less than 0.2 $\mu$m.

18. A dual-coated medical diagnostic radiographic element comprised of a transparent film support having first and second major surfaces and, coated on each of said major surfaces, a layer unit for producing a viewable silver image following image exposure and processing containing radiation-sensitive silver halide grains, a reducible silver salt of a mercapto or thione substituted triazole, a developing agent, and a gelatino-hydrophilic colloid vehicle, the radiation-sensitive silver halide grains including tabular grains having {100} major faces, containing greater than 90 percent chloride, based on silver, accounting for greater than 90 percent of total silver halide grain projected area, and exhibiting an average thickness of less than 0.2 $\mu$m.

19. A method of obtaining a viewable radiographic image comprising mounting a dual-coated radiographic element according to claim 1 between a pair of fluorescent intensifying screens to create an imaging assembly, positioning a subject to be examined between the assembly and a source of X-radiation, exposing the subject to a beam of X-radiation having an energy level in the range of from 25 to 125 kVp, removing the dual-coated radiographic element from the assembly, and heating the dual-coated radiographic element to an elevated temperature in the range of from 90° to 180° C.

20. A method according to claim 19 wherein the dual-coated radiographic element is maintained at the elevated temperature for a period of from 0.5 to 60 seconds.

* * * * *